United States Patent [19]

Wührer

[11] 4,406,635

[45] Sep. 27, 1983

[54] MARINE VESSEL WITH AT LEAST ONE PROPELLER

[75] Inventor: Wolfgang Wührer, Ravensburg, Fed. Rep. of Germany

[73] Assignee: Escher Wyss GmbH, Ravensburg, Fed. Rep. of Germany

[21] Appl. No.: 358,006

[22] Filed: Mar. 15, 1982

[30] Foreign Application Priority Data

Apr. 22, 1981 [CH] Switzerland ..... 2627/81

[51] Int. Cl.[3] ..... B63H 5/06; B63B 1/22

[52] U.S. Cl. ..... 440/69; 114/286

[58] Field of Search ..... 114/284, 285, 286, 288, 114/290; 440/66, 68, 69, 70

[56] References Cited

U.S. PATENT DOCUMENTS

| | | | |
|---|---|---|---|
| 3,159,131 | 12/1964 | Frederick | 114/285 |
| 3,371,642 | 3/1968 | Joy | 114/285 |
| 3,830,190 | 8/1974 | Mantle | 440/66 |
| 3,938,458 | 2/1976 | Irgens | 114/285 |
| 4,371,350 | 2/1983 | Kruppa et al. | 440/69 |

*Primary Examiner*—Trygve M. Blix
*Assistant Examiner*—Rodney Corl
*Attorney, Agent, or Firm*—Werner W. Kleeman

[57] ABSTRACT

Essentially one-half of the circumference of the propeller of the marine vessel is arranged in a tunnel having a flow-favorable cross-sectional configuration which follows the flow lines of the water. At the starting region of the tunnel there is arranged a pivotable control plate which can be moved out of a retracted position where it lies in the surface of the tunnel into an extended position removed or remote from the aforesaid retracted position, in order to detach the flow of the water from the surface of the tunnel during rapid vessel travel. The propeller which is driven at a high rotational speed accordingly operates as a partially or semi-immersed propeller. The vessel floor and the control plate are interconnected by an elastically deformable cover plate which is secured to the vessel floor and the control plate in a bending or flexurally resistant fashion. This cover plate, both in the retracted as well as in the extended position of the control plate, affords a particularly flow-favorable covering of the gap or space formed between the vessel floor and the control plate. The front edge of the control plate is connected with the vessel hull by means of bearing or pillow blocks movable in the direction of travel of the vessel. The bearing blocks possess arm members which are increasingly elastically deformable in the direction of the retracted position of the control plate.

7 Claims, 6 Drawing Figures

5
W'
W
A
B
12
16
14
15a
20
15
15'
20'
IV
36
35
18
37
21b
21'
21
V
28
30
32
33
13
22
31
17
32'
21a
3

12
26
21
26
25

24
12
24
23
21
23
25

MARINE VESSEL WITH AT LEAST ONE PROPELLER

CROSS-REFERENCE TO RELATED APPLICATION

This application is related to the commonly assigned, copending U.S. application Ser. No. 06/191,381, filed Sept. 29, 1980, entitled "Marine Vessel With Propeller" and listing as the inventors Claus Kruppa and Wolfgang Wührer.

BACKGROUND OF THE INVENTION

The present invention relates to a new and improved construction of a marine vessel containing at least one vessel propeller.

Generally speaking, the marine vessel of the present development is of the type wherein the aforementioned at least one propeller is located essentially over one-half of its circumference within a tunnel formed at the floor or bottom of the hull or body of the vessel. The tunnel possesses a flow-favorable transitional shape which follows the flow lines of the water and which transitional shape is developed at the region of the floor of the vessel. At the transition region between the surface of the vessel floor and the tunnel there is arranged a retractable and extendable control plate which is pivotably mounted at the hull or body of the vessel and merges with the floor surface of such vessel.

Such type of marine vessel has been disclosed in the aforementioned copending U.S. application Ser. No. 06/191,381 and the cognate German Patent application No. 30 05 682.7. With such design of marine vessel the control plate is pivotably connected in a hinge-like fashion at a shaft arranged transversely with respect to the direction of travel of the marine vessel and can be positionally adjusted by means of a piston-and-cylinder mechanism between a retracted position, where the control plate bears against the surface of the tunnel, and an extended position remote from such tunnel surface. With such arrangement there can arise at the transition location between the vessel floor and the control plate at both of these parts damage because of cavitation erosion. Furthermore, the transition location can become contaminated by foreign bodies or particles, and thus, can impair the mobility and functional reliability of the control plate.

SUMMARY OF THE INVENTION

Therefore, with the foregoing in mind it is a primary object of the present invention to provide a new and improved construction of a marine vessel containing at least one propeller which is not afflicted with the aforementioned drawbacks and limitations of the prior art discussed above.

Another and more specific object of the present invention is to improve at a marine vessel of the aforementioned type the arrangement and the drive of the control plate and to provide a flow-favorable connection as possible between the control plate and the floor or bottom of the vessel.

Now in order to implement these and still further objects of the invention, which will become more readily apparent as the description proceeds, the marine vessel of the present development is manifested by the features that at the transition location between the floor of the vessel and the control plate there is arranged an elastically deformable cover plate which covers the gap between the vessel floor and the control plate. Both in the retracted position and in the extended position of the control plate the cover plate extends along the flow lines. The front edge of the control plate is connected with the vessel hull or body by a mounting or support arrangement which is movable in the direction of travel of the vessel but essentially stationary in the vertical direction. This mounting arrangement comprises bearing or pillow blocks containing elastically deformable arm members, and the shape of the bearing blocks is selected such that the deformation of the arm members increases in the direction of the retracted position of the control plate.

The control plate constructed according to the teachings of the invention ensures, both in the retracted as well as in the extended position, for an optimum guiding of the flow extending along such control plate. In particular, there is avoided the formation of an open gap exposed to the water flow and extending transversely thereto, and thus, there is obtained a practically undisturbed flow contour. The changes in the width of the covered gap formed between the vessel floor and the front edge of the control plate, and caused by the elastic deformation of the cover plate, are taken up in each instance by the corresponding elastic deformations of the arm members of the bearing or pillow blocks or equivalent structure. Because of the increasing deformation of these arm members in the direction of the retracted position of the control plate, there is exerted upon such cover plate a tensile or tension force directed opposite to the travel direction and having an action upon the cover plate in the sense of elongating the same. This tension force, at least in the retracted position of the control plate, prevents a fluttering or undulation of the cover plate. Equally, because of the relaxation of the arm members of the bearing blocks there is rendered possible an accelerated extension of the control plate accompanied with relatively modest energy requirements.

Furthermore, the arm members of the bearing blocks possess a pre-stress which is predetermined by a starting region of their elastic deformation already in a base position corresponding to the extended position of the control plate. By virtue of this design the cover plate, also in the extended position of the control plate, is maintained under a continuous tensile stress, so that there is prevented a fluttering of the cover plate practically in every position of the control plate.

The elastic cover plate can be constituted by a metallic strip member, for instance a sheet metal strip member, whose marginal or edge portions which extend transversely with respect to the direction of travel of the vessel are each connected in a bending or flexurally resistant fashion with the vessel hull and the control plate, respectively. This design constitutes a particularly suitable construction when there are performed frequent retraction and extension movements of the control plate, affording a favorable loading of the cover plate in that, the zone of maximum deformation of such cover plate is shifted away from the clamping or attachment location.

The cover plate can be connected with the vessel hull and the control plate by respective welding seams which deviate from a linear or straight line, these welding seams at least in sections extending mutually offset from one another essentially in the direction of travel of the vessel. By virtue of this construction there is ensured for a positive and flow-favorable mounting of the cover plate in a most simple fashion.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
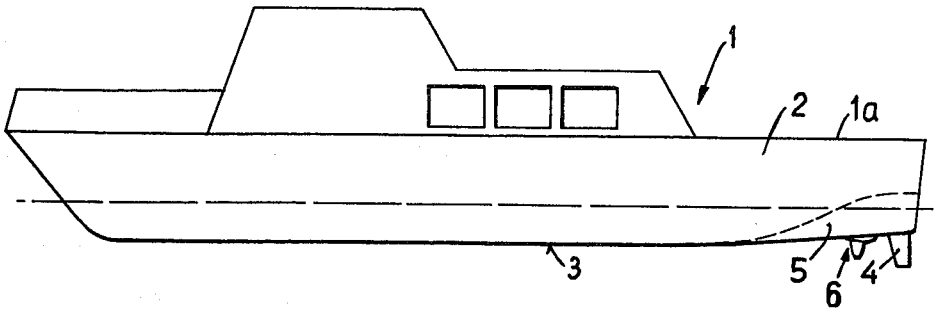
FIG. 1 is a side view of a marine vessel constructed according to the invention.
Figure 2:
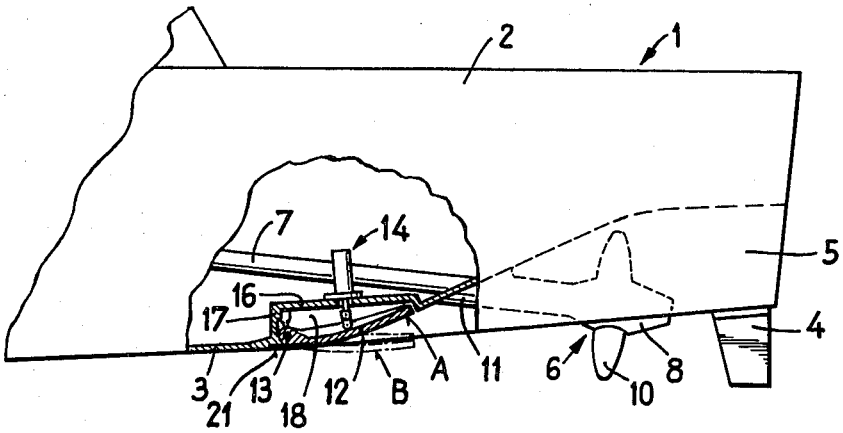
FIG. 2 is a fragmentary view of the marine vessel depicted in FIG. 1, specifically showing the stern or rear region thereof, and depicting in partial sectional view details of the marine vessel construction with the control plate or plate member in its retracted position.

Describing now the drawings, in FIGS. 1 and 2 there has been illustrated a marine vessel 1 having a body or hull 2 with a bottom or floor 3. At the stern 1*a* of the vessel 1 there are arranged control rudders 4. At the vessel's bottom or floor 3 there are formed at the stern 1*a* of the vessel 1, for instance, two adjacently arranged tunnels 5. In each of these tunnels 5 there is located a respective propeller 6 approximately over one-half of its circumference.

These vessel propellers 6 can be preferably constructed as adjustable propellers which, as best seen by referring to FIG. 2, each contain a hub 8 arranged upon a related propeller shaft 7 and equipped with propeller vanes 10 or the like. Each of the propeller vanes 10 are adjustable about their related axis which is disposed essentially perpendicular to the corresponding propeller shaft 7. Moreover, each propeller shaft 7 is mounted in a bearing tube 11 appropriately affixed at the not particularly referenced wall of the related tunnel 5 and is coupled with a not here further shown, but conventional drive motor arranged within the interior or body 2 of the marine vessel 1.

At the transition region between the vessel floor or bottom 3 and the tunnel 5 there is arranged a control plate or plate member 12 which is pivotable about a shaft 13 extending transversely with respect to the direction of travel of the marine vessel 1. This pivotable control plate member 12 can be selectively adjusted by any suitable drive, here in the form of a piston-and-cylinder mechanism 14 between a retracted operating position A, shown in full lines in FIG. 2, and an extended operating position B, shown in phantom lines in such FIG. 2. This control plate or control plate member 12 possesses a form or configuration which is accommodated to the transition region and is structured such that in the retracted position A it snugly merges with the wall of the related tunnel 5 which is formed so as to have a flow-favorable course and follows the flow lines of the water, whereas in the extended position B such control plate 12 is raised or positioned remotely from the wall of the tunnel 5 and causes a tearing-away of the water flow from the end of the control plate 12.

During slow travel of the marine vessel 1 the control plate 12 is fixedly retained in the retracted operating position A by the action of the conventional piston-and-cylinder mechanism 14. This retracted operating position A of the control plate 12 allows for a practically turbulent-free flow of the water through the entire tunnel 5. In corresponding manner the ship propeller 6 which is driven at a low rotational speed operates fully immersed in the water.

During rapid travel of the marine vessel 1 the control plate 12 is fixedly retained in the extended position B by the action of the piston-and-cylinder mechanism or unit 14, and by virtue of the tearing-away of the water flow from the end of the control plate 12—with minimum increase of the flow resistance and without any appreciable increase in the turbulence losses in the water flow extending along the vessel 1—there is obtained a faultless detachment of the flow from the walls of the tunnel 5. In corresponding manner, in each instance at the same time only a part of each related propeller 6, for instance one-half of such propeller, which is driven at a higher rotational speed, immerses into the water, so that each such propeller 6 can operate as a semi-immersed propeller.

The piston-and-cylinder mechanism 14 which is provided for the purpose of actuating the control plate 12 is arranged such that the piston rod 15 extends transversely and approximately upright with respect to the control plate 12 and is sealingly attached at a floor or bottom portion 16 which is inset or rearwardly offset with respect to the floor 3 and with respect to the contour of the tunnel 5 which is governed by the retracted position A of the control plate 12. The floor or bottom portion 16 delimits or bounds by means of a wall portion 17 extending transversely with respect to the direction of travel of the vessel 1 a pocket or niche 18 which enlarges the tunnel 5 and which is covered by the control plate 12 in the retracted position A.

Figure 3:
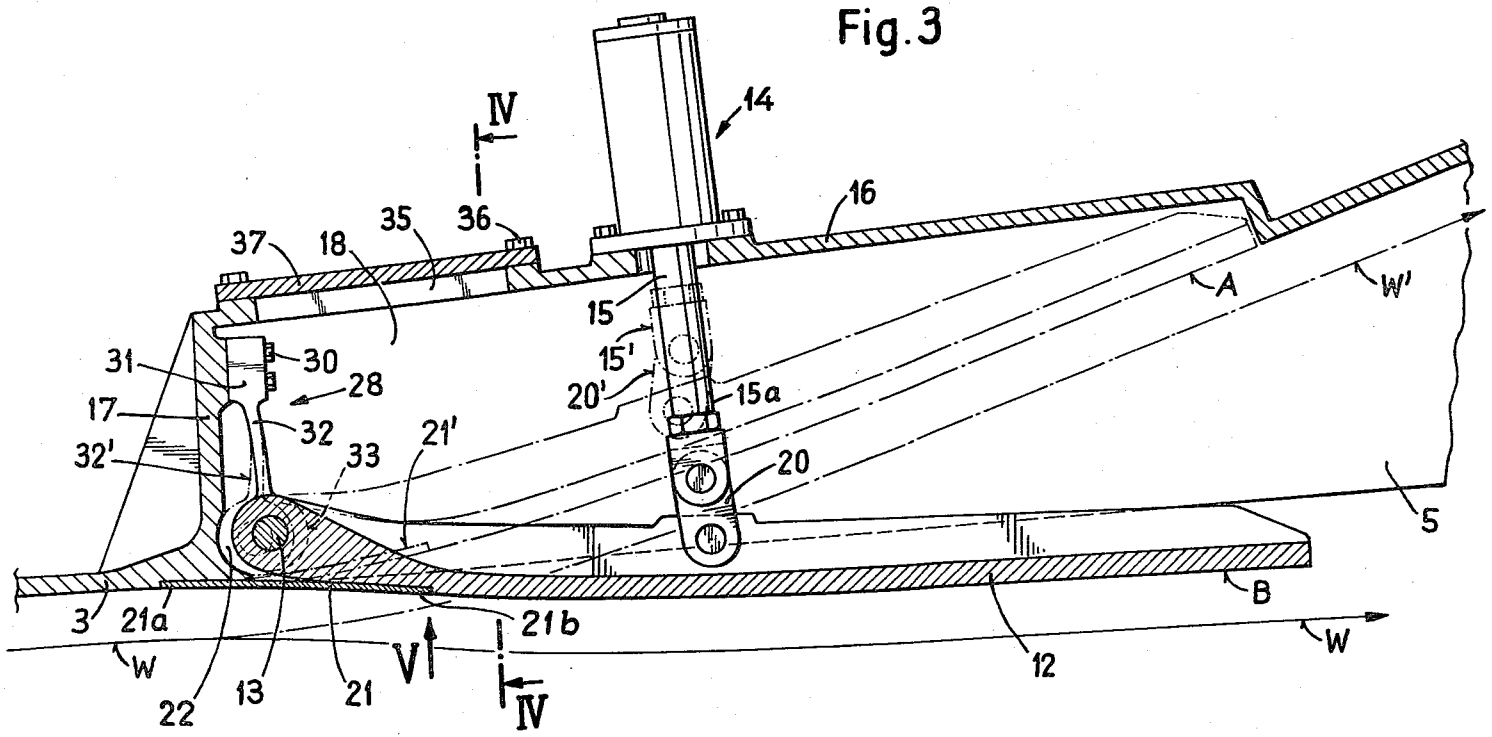
FIG. 3 is an enlarged partial sectional view of the arrangement of FIG. 2, with the control plate in its extended position.
Figure 5:
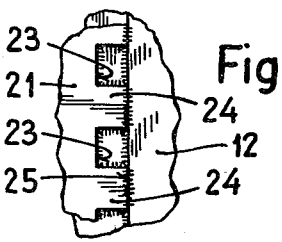
FIG. 5 is a fragmentary view of the control plate, viewed looking essentially in the direction of the arrow V of FIG. 3.

As will be particularly evident by referring to FIG. 3, the end 15*a* of the piston rod 15 is hingedly connected with a bracket member 20 articulated to the control plate 12. The control plate 12 and the vessel floor or bottom 3 are connected with one another by an elastically deformable cover plate or plate member 21 which is formed from a metallic strip, for instance a sheet metal strip. This elastically deformable cover plate 21 covers a gap or space 22 which is present at the transition location between the vessel floor 3 and the control plate 12. The cover plate or plate member 21 is inserted in the vessel floor 3 and the control plate 12 so that the outer surface of such cover plate 21 is flush with the related outer surfaces of such vessel floor 3 and the control plate 12. Moreover, such cover plate 21 is secured so as to be bending-resistant with such vessel floor 3 and the control plate 12 at each one of its respective edges 21*a* and 21*b*, respectively, both of which extend transversely with respect to the direction of travel of the marine vessel 1. For this purpose both of the edges 21*a* and 21*b* of the cover plate 21, as best seen by referring to FIG. 5, can possess a respective fork or tine-like configuration constituted by recesses or cutouts 23, for instance of rectangular sectional shape, and projections or tongues 24, which enable the formation thereat of an approximately zig-zag shaped welding seam which deviates from a straight line. Each such weld seam is composed approximately of respective butt welds extending at the region of the projections 24 along an edge 25 of the control plate 12 and the vessel floor 3, respectively, and hollow welds extending along the edges of the cut-outs 23. In order to obtain a smooth flow-favorable surface the recesses formed by the cut-outs 23 and the edges 25 can be filled by applying welding material.

Figure 6:
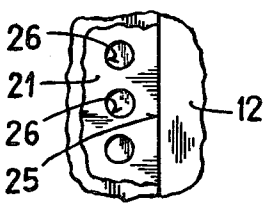
FIG. 6 is a corresponding fragmentary view of a different exemplary embodiment of control plate.

It should be understood that the edges 21*a* and 21*b* of the cover plate 21 in each case could also be structured to have a randomly different configuration, for instance could possess triangular-shaped or arcuate-shaped cut-outs. The cover plate 21 can also be provided with slots or, as shown in FIG. 6, be equipped with substantially circular-shaped recesses 26 for the application of plug or slot welds which, in conjunction with a continuous welding seam extending in each case along the edge 25, likewise ensures for a bending-resistant attachment of the relevant edge 21*a* and 21*b* of the cover plate or plate member 21.

The shaft 13 of the control plate 12 is mounted in two bearing or pillow blocks 28 or equivalent structure which are movable in the direction of vessel travel. Each of these bearing blocks 28 possesses a holder portion or element 31 secured by means of threaded bolts 30 or equivalent fastening expedients at the wall portion 17, an arm member 32 which is elastically deformable in the direction of vessel travel and practically rigid transversely with respect to such travel direction, and a hub 33 connected with the related arm member 32 for the reception of the shaft 13.

Figure 4:
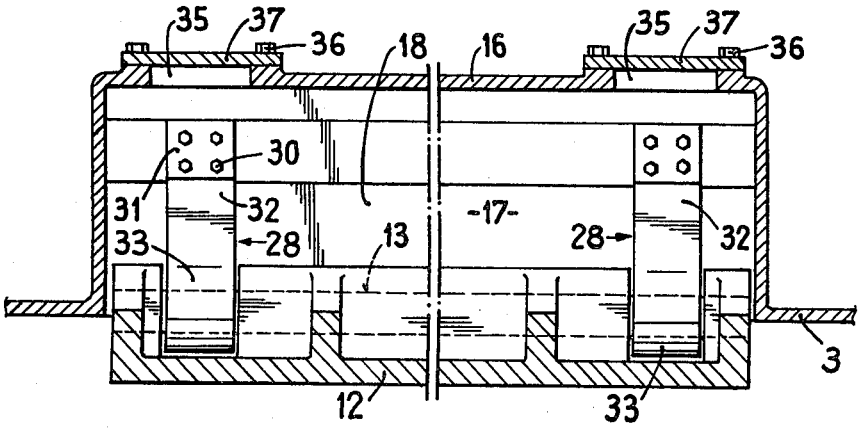
FIG. 4 is a partial sectional view of the arrangement of FIG. 3, taken substantially along the line IV—IV thereof.

Each of the bearing or pillow blocks 28 is adjusted with a pre-stress or tension, indicated in FIG. 3 by a slight curvature of the arm member 32 shown in full lines, this pre-stress acting upon the control plate 12 in the sense of widening the gap or space 22. In corresponding manner the cover plate 21 is retained in a stressed fashion in the sense of an elongation thereof already in the illustrated extended position B of the control plate 12. At the floor or bottom portion 16 there can be provided mounting or assembly openings 35 which render accessible the pocket 18 from the interior of the vessel 1 in order to facilitate the mounting of the bearing blocks 28 and for the exact setting and adjustment of the connection between the piston rod 15 and the control plate 12. The mounting openings 35 are each closed by a respective cover member 37 which can be closed from the interior of the vessel 1 with the aid of the threaded bolts 36 or equivalent structure, as best seen by referring to FIGS. 3 and 4.

If by appropriately actuating the piston-and-cylinder mechanism 14 the piston rod 15, the bracket 20 and the control plate 12 are brought into the retracted positions 15', 20' and A, respectively, shown in phantom lines in FIG. 3, then by virtue of the thus resulting elastic deformation of the cover plate 21 the latter is moved into the position 21' and the left-hand end of control plate 12, shown in FIG. 3, along with the hubs 33 of the bearing blocks 28 are moved towards the wall portion 17. Consequently, the arm members 32 undergo an increasing elastic deformation which has been indicated in FIG. 3 by the phantom line illustrated end position 32'. The control plate 12 and the cover plate 21 are thus continually exposed to the action of a force caused by the pre-biasing or stressing of the arm members 32, this force continuously increasing during retraction of the cover plate 12 towards the retracted position A and facilitating or accelerating an extension or outward movement of the cover plate 12 in that, by virtue of the relaxing arm members 32 there is augmented such extending movement of the cover plate 12. Additionally, the tension force which opposes the direction of travel of the vessel and which acts because of the pre-bias of the arm members 32 upon the cover plate 21 precludes any fluttering of the cover plate 21.

By virtue of the cover plate 21 which covers the gap or space 22 there is obtained, both in the extended position B and also in the retracted position A of the control plate 12, a practically disturbance-free flow of the water. This water flow has been indicated in FIG. 3 by a flow line W shown in full lines corresponding to the extended position B and a flow line W' shown in phantom lines and corresponding to the retracted position A.

Instead of using two vessel propellers, as has been indicated by way of example and not limitation with the previously described exemplary embodiments, it is of course to be understood that also a greater number, such as three vessel propellers could be employed, or even only a single propeller. Furthermore, two or more propellers could be arranged in a common tunnel.

While there are shown and described present preferred embodiments of the invention, it is to be distinctly understood that the invention is not limited thereto, but may be otherwise variously embodied and practiced within the scope of the following claims. Accordingly,

What I claim is:

1. A marine vessel comprising:

a vessel hull having a floor portion;

a tunnel provided at the floor portion of said vessel hull;

at least one propeller located essentially throughout approximately one-half of its circumference within said tunnel;

said tunnel having a flow-favorable transitional shape which substantially follows flow lines of the water and is developed as an extension of the floor portion of the vessel hull;

a transition region formed between a surface of the floor portion and said tunnel;

a retractable and extendable control plate arranged at said transition region between the surface of the floor portion and said tunnel;

means for pivotably mounting said control plate at the vessel hull and with said control plate merging with the surface of the floor portion;

an elastically deformable cover plate arranged at the transition region between the floor portion and the control plate;

said cover plate covering a gap between the floor portion and the control plate;

said cover plate extending along flow lines of the water both in the retracted position and the extended position of the control plate;

said control plate having a front edge;

mounting means for connecting said front edge of said control plate with the vessel hull;

said mounting means being movable in the direction of travel of the marine vessel and essentially stationary in vertical direction of the marine vessel;

said mounting means comprising bearing blocks equipped with elastically deformable arm members with which there is connected the front edge of the control plate; and each of said bearing blocks being structured such that the deformation of the arm members increases in the direction of the retracted position of the control plate.

2. The martine vessel as defined in claim 1, wherein:

said arm members of said bearing blocks possess a pre-stress which is governed by a starting region of their elastic deformation already in a base position corresponding to the extended position of the control plate.

3. The marine vessel as defined in claim 1 or 2, wherein:

said elastically deformable cover plate comprises a metallic strip member;

said metallic strip member having edge portions extending transversely with respect to the direction of travel of the vessel; and one of said edge portions being connected in a substantially flexurally stiff manner with the vessel hull and the other of said edge portions being connected in a substantially flexurally stiff manner with said control plate.

4. The marine vessel as defined in claim 3, wherein:

said metallic strip member comprises a sheet metal strip member.

5. The marine vessel as defined in claim 3, further including:

respective welding seams deviating from a straight line for respectively connecting the cover plate with the vessel hull and with the control plate; and at least portions of said welding seams extending in mutually offset relationship to one another essentially in the direction of travel of the vessel.

6. The marine vessel as defined in claim 1, further including:

a piston-and-cylinder mechanism for adjusting said control plate; and said piston-and-cylinder mechanism containing a piston rod disposed essentially transversely with respect to the control plate.

7. A marine vessel comprising:

vessel hull having a vessel floor portions;

a tunnel provided at the vessel floor portion of said vessel hull;

at least one propeller located at least partially within said tunnel;

said tunnel having a shape which merges with a surface of the vessel floor portion;

a transition region formed between the surface of the vessel floor portion and said tunnel;

a retractable and extendable control plate arranged at said transition region between the surface of the vessel floor portion and said tunnel;

means for pivotably mounting said control plate at the vessel hull;

drive means for selectively operating said retractable and extendable control plate;

an elastically deformable cover plate arranged at the transition region between the vessel floor portion and the control plate;

said cover plate covering a gap between the vessel floor portion and the control plate;

said cover plate extending along flow lines of the water both in the retracted position and the extended position of the control plate;

said control plate having a front edge;

mounting means for connecting said front edge of said control plate with the vessel hull;

said mounting means being movable in the direction of travel of the marine vessel and essentially stationary in vertical direction of the marine vessel;

said mounting means comprising bearing block means equipped with elastically deformable arm means and with which there is connected the front edge of the control plate; and each of said bearing block means being structured such that the deformation of the arm means increases in the direction of the retracted position of the control plate.

* * * * *